United States Patent [19]

Greene

[11] 4,455,756

[45] Jun. 26, 1984

[54] DEVICE FOR HANGING PICTURES

[76] Inventor: Gordon D. Greene, 787 Prospect Ave., Winnetka, Ill. 60093

[21] Appl. No.: 334,125

[22] Filed: Dec. 24, 1981

[51] Int. Cl.[3] ..... A47G 1/20; A47G 1/17

[52] U.S. Cl. ..... 33/180 R; 33/189; 248/547

[58] Field of Search ..... 248/547, 544; 33/180 R, 33/189

[56] References Cited

U.S. PATENT DOCUMENTS 2,723,815 11/1955 Browning ..... 248/547 X 3,530,591 9/1970 Moffitt ..... 33/180 R 3,599,686 8/1971 Peebles ..... 248/547 X 4,220,309 9/1980 Eisen et al. ..... 248/547 X

*Primary Examiner*—William D. Martin, Jr.

*Attorney, Agent, or Firm*—Tilton, Fallon, Lungmus & Chestnut

[57] ABSTRACT

A device for hanging pictures including an elongated metal member, an opening extending through the member, and equipped with a bracket having a ledge portion for supporting a picture hook in the opening in the metal member, and adhesive tape adjacent the opening for securing the hook on the elongated member.

1 Claim, 5 Drawing Figures

FIG. 1
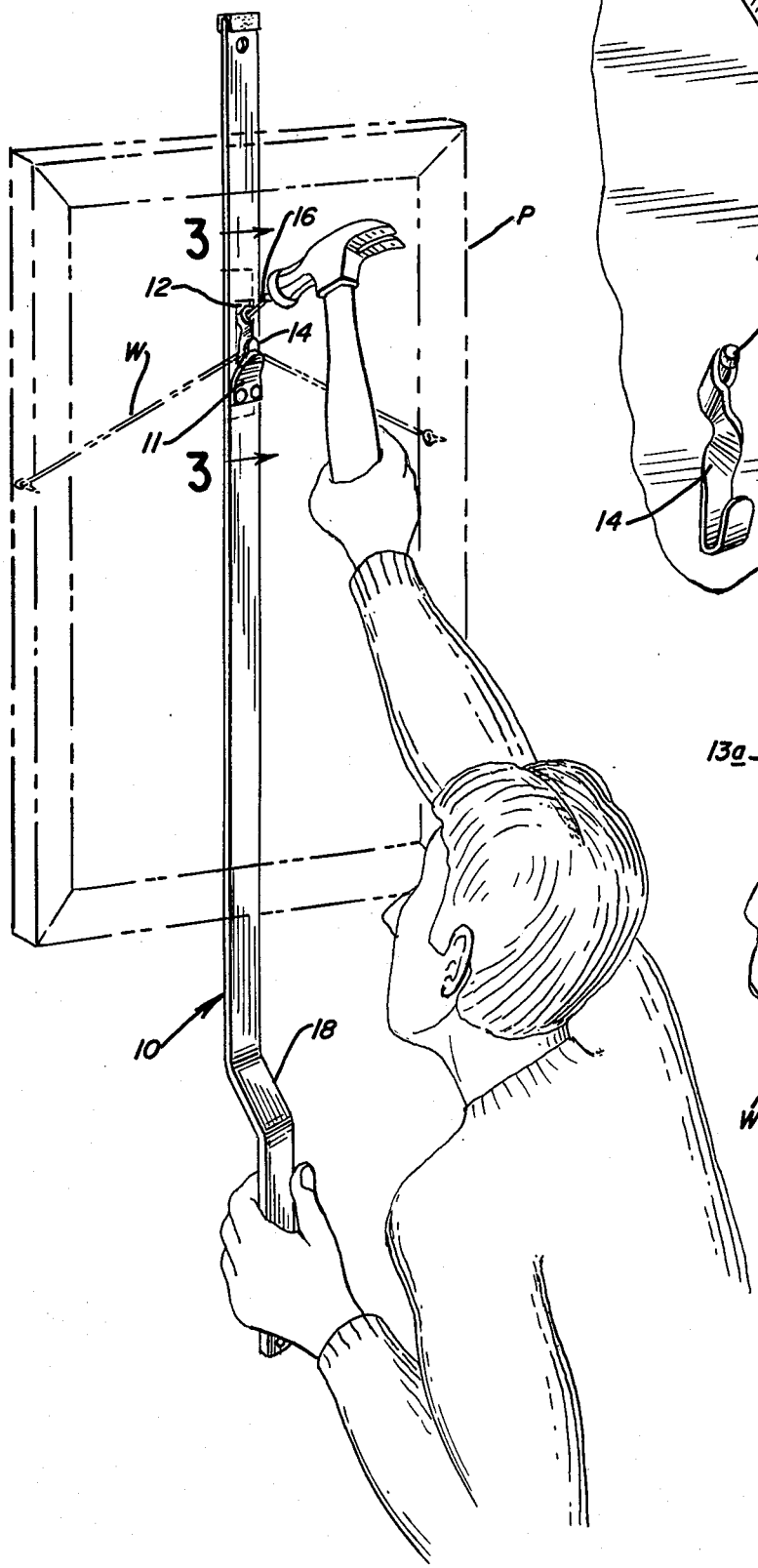
FIG. 2
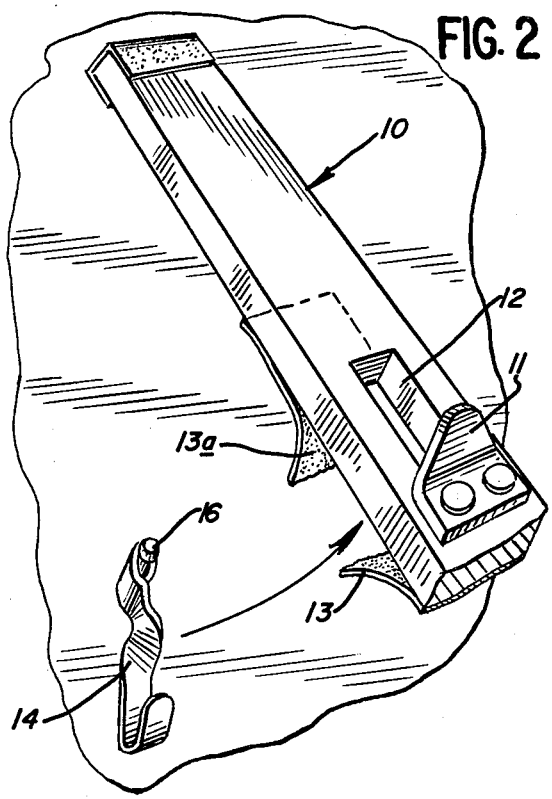
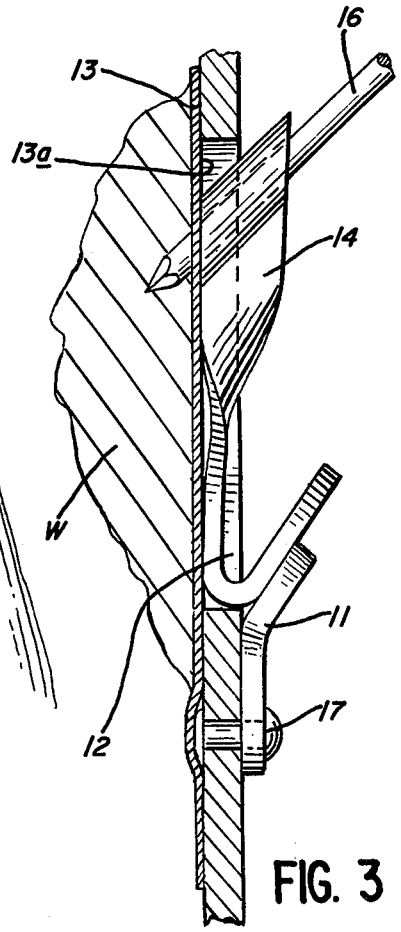
FIG. 3

DEVICE FOR HANGING PICTURES

BACKGROUND AND SUMMARY OF INVENTION

A device for hanging pictures and, more particularly, one which facilitates the placement and hanging of a picture without the need for taking measurements.

Devices for achieving the above mentioned objective have been tried in the past—as for example, U.S. Pat. No. 3,516,165. There it is required that the hanger pierce the wall with a sharp object in order to locate the hook site. This was not only awkward, but difficult and is a drawback of the prior art solved by the instant invention.

According to the instant invention, a hook is temporarily supported on the locating device and in position to carry the picture intended for mounting. Once the desired location has been achieved by manually moving the device about, the picture is removed whereupon the hook is in immediate position for installation. According to the illustrated embodiment, the hook is temporarily maintained in place within a slot in the elongated device through the cooperation of an abutment or bracket and a rupturable adhesive band.

Further objects and advantages of the invention may be seen in the details of the ensuing specification.

The invention is described in conjunction with the accompanying drawing, in which:

FIG. 1 is a perspective view of the inventive device with a picture depicted in phantom line;

FIG. 2 is another perspective view but in a subsequent state of operation;

FIG. 3 is an enlarged fragmentary view partially in section of the portion of the device carrying the hook and which is seen essentially along the sight line 3—3 applied to FIG. 1;

DETAILED DESCRIPTION

Figure 4:
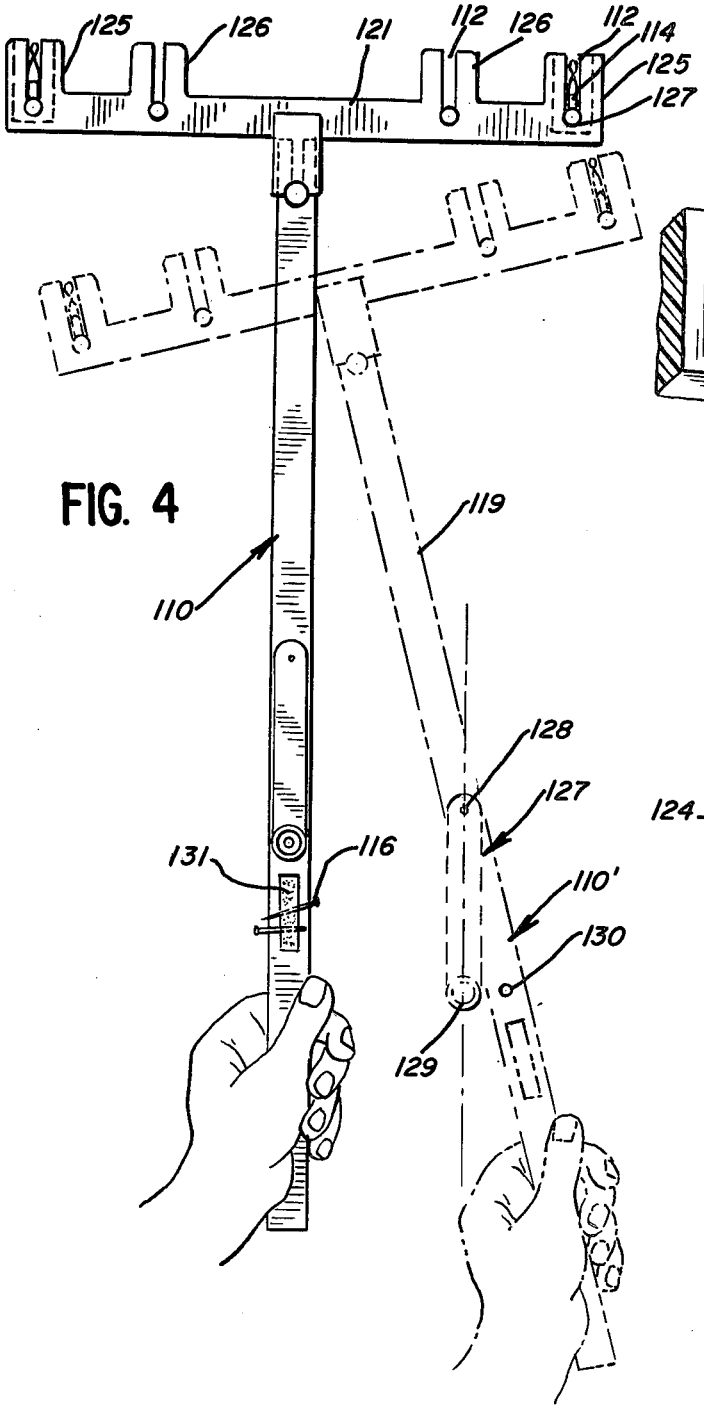
FIG. 4 is a front elevational view of a modified version of the device with an initial stage depicted in dotted line.

In the illustration given and with reference first to FIG. 1, the numeral 10 designates generally the inventive device employed for hanging a picture P which is seen in phantom line. The picture P also includes the usual wire W suitably affixed to the back of the picture frame.

The device 10 may be an elongated metal member and is equipped adjacent its upper end with a bracket 11. Provided immediately above the bracket 11 is a through slot 12 (compare FIGS. 2 and 3) which is initially closed by means of an adhesive tape or band 13. The numeral 14 designates a conventional hook which is installed in the slot 12 and maintained temporarily in place by means of the bracket 11.

In the operation of the device, the hook 14 is placed within the slot 12 and is temporarily maintained in place by means of the adhesive facing 13*a* (see FIG. 3). The bottom portion of the hook is supported by the bracket 11 and thereafter a picture P is suspended on the hook 14 in the fashion indicated in FIG. 1. More particularly, the wire W is placed in the hook 14 and thereafter the device 10 is moved until the desired location for picture mounting is achieved. Thereafter, the picture can be removed using one hand while the other hand of the person hanging the picture still maintains the device 10 in position. A nail 16 is then inserted into the eye of the hook 14 and hammered into the wall as indicated in FIG. 1. Incident thereto the nail 16 penetrates the adhesive band 13 and upon removal of the device 10 the band is ruptured in the fashion seen in FIG. 2.

The device 10 is advantageously constructed of a strip of lightweight metal such as aluminum and the bracket 11 can be secured thereto as by rivets 17. Also, the device 10 is advantageously offset as at 18 (see FIG. 1) so as to have the grasping portion spaced suitably from the wall W (see FIG. 3).

Figure 5:
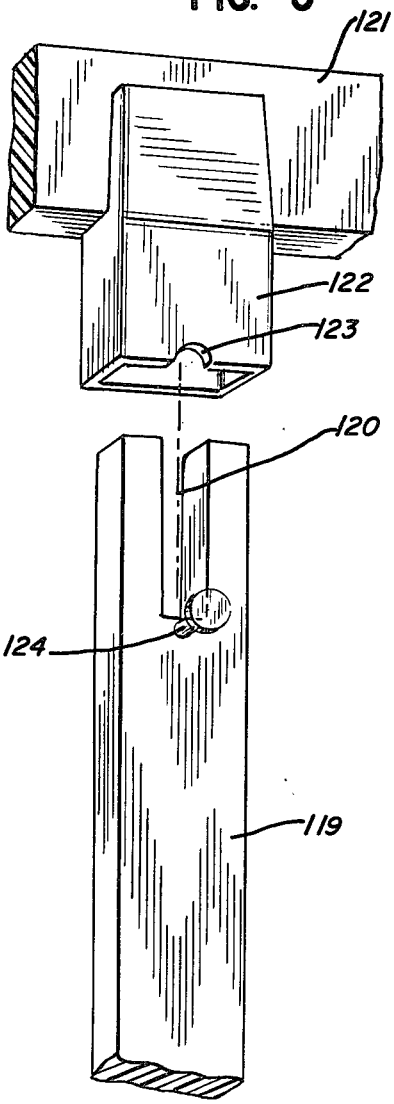
FIG. 5 is an enlarged fragmentary perspective view of the device of FIG. 4 in still an earlier stage of operation.

Reference is now made to FIGS. 4 and 5 wherein a second embodiment of the invention is disclosed which is particularly suited for installing pictures requiring two supporting hooks—as is commonly the practice in California where earthquakes and tremors are experienced and in other places subject to vibrations: elevators, jets, door slamming or housekeeping chores generally, i.e., wiping down frames and glass. To this end, an elongated device generally designated 110 is employed. The device 110 may include an elongated member of metal or wood as at 119 (see particularly FIG. 5). The member 119 is equipped with a slot as at 120 at its upper end so as to permit the installation of a single hook in the fashion previously described with respect to FIGS. 1–3.

Where, however, dual hooks are desired, a cross bar member 121 is provided and equipped with a sleeve 122 affixed thereto which slides over the upper end of the elongated member 119. Rigidity is afforded by the cooperation of a semicircular recess 123 adapted to cooperate with the shank of a rivet or bolt 124.

The cross bar 121 is equipped with upwardly extending projections arranged in pairs as at 125 and 126 depending upon spacing of the hooks desired. Each projection carries its associated slot 112 and which is suitably backed by an adhesive tape for installation of a hook 114 in the fashion previously described with respect to the first embodiment of FIGS. 1–3. The projections 125 or 126 are each equipped with rivets or bolts 127 to provide the abutment or bracket for the support of the bottom portion of the hook 114. The installation parallels that previously described except that two hooks are installed for each picture. However, the initial steps are the same—the picture being removably supported by its wire on the hooks 114 and thereafter removed after the desired location has been ascertained.

Helpful in making sure that the picture is level or plumb is the provision of a plumb element generally designated 127 and which is pivotally mounted as at 128 on the elongated member 119. As can be appreciated from a consideration of the dotted line showing in FIG. 4 with the solid line showing, the device 110 is moved from the dotted line position designated 110' where the plumb element 127 is not aligned with the elongated member 119 to the solid line position. At such time the circular opening 129 in the plumb member 127 is aligned with the index dot 130 provided on the elongated member 119.

An additional advantageous feature is provided in the form of a small magnetic bar 131 installed in the elongated member 119. This provides for the releasable mounting of nails 116 so that the same can be conveniently removed one at a time for installation without concern on the part of the person hanging the picture that the nails be dropped and the located position lost while retrieving the nails.

While in the foregoing specification a detailed description has been given of the invention for the purpose of illustration, many variations in the details herein-given may be made by those skilled in the art without departing from the spirit and scope of the invention.

I claim:

1. A device for hanging pictures comprising a relatively thin elongated member, an opening extending through said member and equipped with ledge means for supporting a picture hook, a hook positioned in said opening and rupturable tape means engaging said hook and member to stabilize said hook in said opening, said member being equipped with a flat surface for engaging a wall on which a picture is to be hung, said tape means being applied to said surface and providing an adhesive surface exposed by said ledge means is stabilized by said adhesive and upon fastening to said wall remains in position upon removal of said device and attendant rupturing of said tape means, said member being equipped adjacent the bottom thereof with a portion offset from said flat surface to provide a manual grasping portion while positioning said flat surface against a wall.

* * * * *